United States Patent [19]

Giesler

[11] Patent Number: 4,770,314

[45] Date of Patent: Sep. 13, 1988

[54] INSERT FOR A SHELF IN THE INSIDE DOOR OF A REFRIGERATOR

[75] Inventor: Rolf-Dieter Giesler, Kreuztal, Fed. Rep. of Germany

[73] Assignee: Electrolux Siegen GmbH, Siegen, Fed. Rep. of Germany

[21] Appl. No.: 853,036

[22] Filed: Apr. 17, 1986

[30] Foreign Application Priority Data

Apr. 18, 1985 [DE] Fed. Rep. of Germany ... 8511568[U]

[51] Int. Cl.[4] ..... B65D 25/06

[52] U.S. Cl. ..... 220/22.1

[58] Field of Search ..... 220/22.1, 22.2, 22.3, 220/22.4, 22.5, 22.6

[56] References Cited

U.S. PATENT DOCUMENTS

| | | | |
|---|---|---|---|
| 42,802 | 5/1864 | Smith | 220/22.1 |
| 1,688,003 | 10/1928 | Darby | 220/22.3 |
| 2,761,454 | 9/1956 | Reimer | 220/22.4 |
| 3,049,126 | 8/1962 | Myers | 220/22.3 |
| 4,305,217 | 12/1981 | Green | 220/22.5 |

FOREIGN PATENT DOCUMENTS

| | | | |
|---|---|---|---|
| 2644004 | 3/1978 | Fed. Rep. of Germany | 220/22.3 |

*Primary Examiner*—George E. Lowrance

*Attorney, Agent, or Firm*—Birch, Stewart, Kolasch & Birch

[57] ABSTRACT

The insert for a shelf in the inside door of a refrigerator comprises an angular part having a vertical and a horizontal plate and is preferably made of plastic material, which angular part is insertable into the shelf and connected with the inner surface thereof. A bar, which is known per se and has slidable sliders, is combined with the vertical plate of the insert. In either lateral flank of the vertical plate of the insert there is arranged a groove, and on either inner surface of the shelves there are arranged webs opposite to each other, which engage in the grooves when the insert is inserted in the shelf.

7 Claims, 1 Drawing Sheet

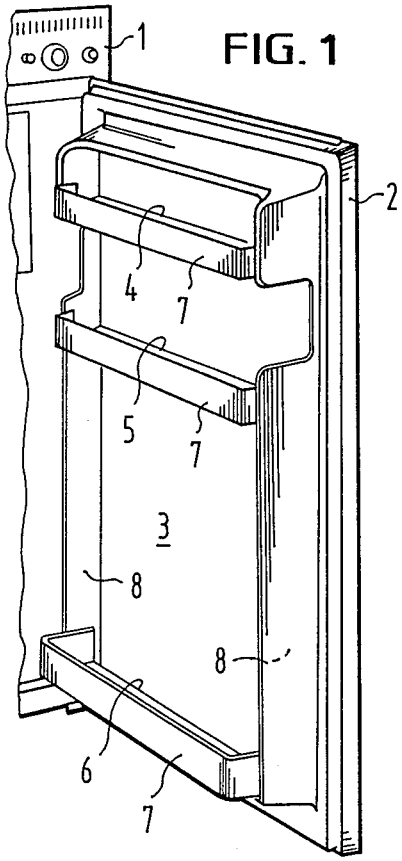
FIG. 1
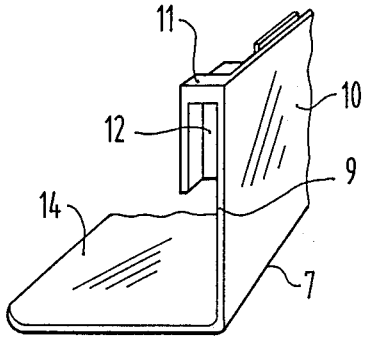
FIG. 2
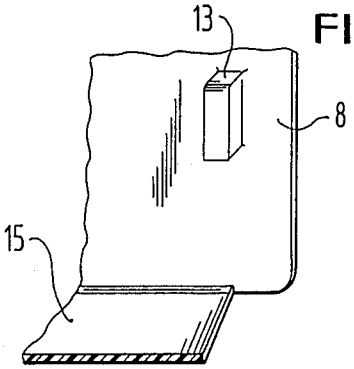
FIG. 3
FIG. 4
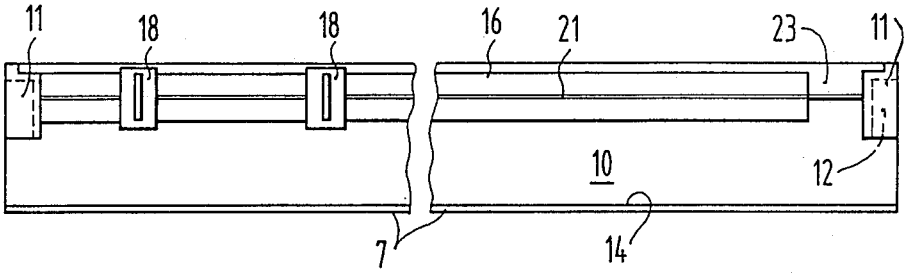
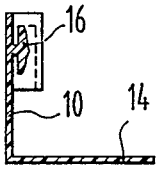
FIG. 5
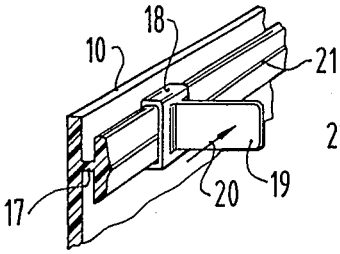
FIG. 6
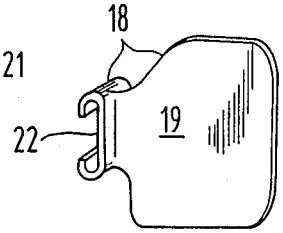
FIG. 7

INSERT FOR A SHELF IN THE INSIDE DOOR OF A REFRIGERATOR

BACKGROUND OF THE INVENTION

The invention relates to an insert for a shelf, preferably for the inside door of a refrigerator, particularly of refrigerators such as they are used in caravans, house bars and in guest rooms of the hotel business and the like. The door of such refrigerators comprises an outer, plane sheathing and a shaped board turned to the interior of the refrigerator, which shaped board mostly comprises a plurality of shelves for placing bottles, beakers, eggs, and the like. It is known to arrange inserts in these shelves, e.g. inserts for eggs, bottles and beakers, so as to give these objects a better support in the refrigerator and also to arrange them clearly.

DESCRIPTION OF BACKGROUND ART

In a known construction the insert is an angular bar, the lateral flanks of which are screwed with the shelf. In another known construction the shelf, which is open towards the interior of the refrigerator, is provided with a bar having the form of a double T and bearing slidable sliders. The shelf is only partially covered by this bar. The sliders serve the purpose to provide the objects arranged in the shelf with a lateral support. For this purpose the sliders have tongues extending into the space of the shelf, so that the objects may be placed therebetween. Also these bars are screwed with the lateral flanks of the shelves by means of headpieces.

It has turned out that these shelves have various disadvantages which are associated with the everyday handling of the refrigerator. For example, the form of the insert of the first kind has the disadvantage that such inserts are not equally suitable for all of the objects which are to be kept in the refrigerator. For example, in an insert for eggs it will hardly be possible to place bottles, and in an insert for bottles there will arise difficulties with the size and the often various diameters of the various bottles. In such a case, inserts of the second kind, which are known in the art, are better because the sliders with their tongues may be well adjusted to the respective width or the respective diameter of the object. However, the latter insert has the drawback that objects, when being tilted as this may happen during the travelling motion of a caravan or a trailer, slip through under the bar, thus falling into the interior of the refrigerator. It may further happen that the comparatively thin and narrow bar will break when e.g. a bottle is hastily seized from the shelf. It has also turned out that the sliders may easily be displaced along the bar when the refrigerator is shaken, so that as a result the objects are loose in the shelf.

SUMMARY AND OBJECT OF THE INVENTION

It is the object of the invention to remove the above deficiencies by providing an insert which on the one hand safely supports the objects contained in the shelf space, and which on the other hand may be inserted into the shelf without sticking or screwing operations.

It shall also be largely non-destructive in case of careless handling by an operating person.

Proceeding from the above cited prior art, the invention is characterized in that at the upward vertical plate of the angular insert there is arranged the bar with its sliders, each of which has a tongue, and that said bar has a clearance for inserting the sliders.

In order to safely support the angular insert in the shelf, the upward vertical plate comprises grooves in each of its lateral flanks, which grooves engage with webs disposed on either side of the lateral walls of the shelf. Thus the insert can be safely prevented from falling out, and screw connections may be avoided. Further details and advantages of the invention will become apparent from the claims.

BRIEF DESCRIPTION OF THE DRAWINGS

An insert according to the invention is shown in the drawings, in which

FIG. 1 shows a refrigerator door with the shelves;

FIG. 2 shows a lateral perspective view of the insert according to the invention;

FIG. 3 shows a segment of a lateral wall part of the shelf of the refrigerator;

FIG. 4 is a plan view to the insert according to FIG. 2, with a view fo the bar;

FIG. 5 is a cross-section through an insert according to FIG. 4;

FIG. 6 is a perspective view of the bar of the insert with a slider, and

FIG. 7 shows another embodiment of slider.

DETAILED DESCRIPTION OF THE PREFERRED EMBODIMENT

The refrigerator 1 according to FIG. 1 has a refrigerator door 2, at the inner shaped board of which there are in the present case molded three shelves 4 to 6. In the upper shelf there are preferably disposed beakers, eggs, and the like, whereas in the middle shelf there may be placed somewhat larger objects such as milk-boxes, smaller bottles and the like. Finally, the lowermost of the shelves, which mostly has a somewhat larger volume, serves for receiving high and larger objects. Owing to the design of the shaped board 3 the shelves are open towards the interior of the refrigerator. Inserts 7 serve e.g. as terminal members of the shelves. These inserts are mostly fixed at the inner surfaces 8 of the shelves, opposite to each other.

As particularly to be seen from FIG. 2, the insert 7 according to the invention is provided with caps 11 at the lateral flanks 9 of the vertical plate 10, into which caps 11 there is molded a groove 12.

FIG. 3 shows an inner surface 8 of a shelf, e.g. 5. As to be seen, there is arranged a web 13 which is so dimensioned that the groove 12 engages on either side over the webs arranged at the inner surfaces of the shelf when the insert is frictionally inserted (force-locking) into the shelf. When the insert is pushed in, the horizontal plate 14 (FIG. 2) will be stopped on the shelf seating surface 15, thus being at rest thereupon. The insert is now safely enough supported in the shelf.

As to be seen from the FIGS. 4 to 6, a bar 16 extends along the inner surface of the vertical plate 10 of the insert 7, which bar 16 is molded on plate 10 perferably by means of a walkway 17. On the bar there are provided slidable sliders 18 which, however, may be displaced only when the tongue 19 of the slider is perpendicular to the bar. If a force acts upon the tongue, shown e.g. by directional marker 20 in FIG. 6, a torque will arise at the slider. Further, a thin web bulge 21, extending over the whole length of the bar 16, will get into engagement with the guide eye 22 of the slider when the latter is tilted, so that the slider will then sit close to the bar. When an object, e.g. a bottle, is placed between two sliders, and said sliders are pressed against each other, then both sliders will be tilted. As a result the bottle will be safely supported even if the refrigerator is shaken, e.g. during the travelling motion of a trailer.

As particularly to be seen from FIG. 4, with the exception of a clearance 23 the bar 16 extends between the two caps 11 of the insert 7, said clearance serving for inserting the sliders upon the bar 16.

As shown in FIG. 7, the tongues 19 of the sliders 18 may have any desired shape. The tongue shown in the drawing is leaf-shaped; however, it may also be spoon like, or it may be arranged e.g. horizontally and have a circular clearance for inserting objects therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Insert for a shelf in the inside door of a refrigerator comprising:

an angular member having a vertical and a horizontal plate and being preferably made of plastic material;

said angular member being insertable into the shelf and connected with an inner surface of said shelf;

a T-shaped bar flange being affixed to an extending along the length of said vertical plate of said angular member, said T-shaped bar flange including a top portion, bottom portion and a middle portion;

slidable slide partitions positioned on said bar for selective lateral displacement;

a web bulge extending over the whole length of said T-shaped bar flange at substantially said middle portion thereof and projecting towards the slidable slide partitions; and a U-shaped guide eye formed at one end of said slidable slide partitions for being operatively positioned on said T-shaped bar flange, said U-shaped guide eye engages said web bulge when said slider is tilted.

2. Insert according to claim 1, characterized in that said vertical plate of the insert includes a lateral flange having a groove, and an inner surface of the shelves includes a web opposite to each other, which engage in the groove when the insert is inserted in the shelf.

3. Insert according to claim 1, characterized in that the bar has a clearance for inserting the sliders.

4. Insert according to claim 1, characterized in that the bar is molded on the plate by means of a walkway.

5. Insert according to claim 1, characterized in that the web bulge extends over the whole length of the bar along the middle thereof.

6. Insert according to claim 2, characterized in that on the one hand the bar extends to a cap of groove, and on the other hand there is provided a clearance between said bar and cap.

7. Insert according to claim 6, characterized in that the insert comprising the vertical and the horizontal plates the bar, and the caps with the grooves is a shaped part made of plastic material.

* * * * *